US006722777B2

(12) United States Patent
Erber

(10) Patent No.: US 6,722,777 B2
(45) Date of Patent: Apr. 20, 2004

(54) REFLECTOR FOR A LIGHT ASSEMBLY, SUCH AS A TAILLIGHT, A HEADLIGHT, OR AN INTERIOR LIGHT, OF A MOTOR VEHICLE

(75) Inventor: Andreas Erber, Ostfildern (DE)

(73) Assignee: Schefenacker Vision Systems Germany GmbH & Co. KG, Esslingen (DE)

( * ) Notice: Subject to any disclaimer, the term of this patent is extended or adjusted under 35 U.S.C. 154(b) by 0 days.

(21) Appl. No.: 10/065,328

(22) Filed: Oct. 4, 2002

(65) Prior Publication Data

US 2003/0067784 A1 Apr. 10, 2003

(30) Foreign Application Priority Data

Oct. 5, 2001 (DE) ..... 101 49 273

(51) Int. Cl.[7] ..... F21W 101/10

(52) U.S. Cl. ..... 362/518; 362/519; 362/297; 362/302; 362/348

(58) Field of Search ..... 362/516, 518, 362/519, 297, 304, 302, 346, 347, 348, 349, 350

(56) References Cited

U.S. PATENT DOCUMENTS 1,153,446 A * 9/1915 Roffy
1,270,261 A * 6/1918 Brueggeman
1,361,354 A * 12/1920 Arnett
4,974,138 A * 11/1990 Negishi ..... 362/347
6,338,564 B1 * 1/2002 Jordan et al. ..... 362/346

* cited by examiner

*Primary Examiner*—Laura K. Tso
(74) *Attorney, Agent, or Firm*—Gudrun E. Huckett

(57) ABSTRACT

A reflector for a light assembly of a motor vehicle has at least one reflector surface for rays emitted by an illumination element positioned at a spacing to the at least one reflector surface. The at least one reflector surface is a surface of revolution whose generatrix is part of a curve and ascends in a direction to the illumination element that is oriented toward the at least one reflector surface. The curve can be a parabola, an ellipse or a free-form curve.

30 Claims, 10 Drawing Sheets

REFLECTOR FOR A LIGHT ASSEMBLY, SUCH AS A TAILLIGHT, A HEADLIGHT, OR AN INTERIOR LIGHT, OF A MOTOR VEHICLE

BACKGROUND OF INVENTION

1. Field of the Invention

The invention relates to a reflector for a light assembly, such as a taillight, a headlight, or an interior light, of a motor vehicle, wherein the reflector comprises at least one reflector surface for rays emitted by an illumination element positioned at a spacing to the reflector surface.

2. Description of the Related Art

Light assemblies, for example, headlight units, are known in which an illumination element is arranged in a housing behind a lens whose light is reflected by a reflector onto the lens. Such light assemblies require a large mounting space. Moreover, the reflector surfaces of such light assemblies present problems in regard to vapor deposition. Moreover, the light emission surface for a predetermined mounting depth of the light assembly cannot be made as large as desired so that in such cases several illumination elements are required.

SUMMARY OF INVENTION

It is an object of the present invention to configure a reflector of the aforementioned kind such that with a minimal mounting height an illuminated surface as large as possible can be achieved.

In accordance with the present invention, this is achieved in that the reflector surface is a surface of revolution whose generatrix is part of a curve and ascends in the direction toward the illumination element which illumination element is oriented toward the reflector surface.

The curve can be a parabola, an ellipse or a free-form curve.

As a result of the configuration according to the invention, the reflector surface ascends in the direction toward the illumination element. In this way, the illumination element can be arranged relatively closely to the reflector surface. The light which is emitted by the illumination element impinges completely on the reflector surface and can be utilized in a targeted way for light distribution. A preferred embodiment of an illumination element is an LED. A single LED is sufficient in order to obtain a large illuminated surface area. The light provided with the reflector according to the invention has only a minimal mounting depth because the illumination element is arranged at a minimal spacing relative to the reflector surface.

DETAILED DESCRIPTION

Figure 1:
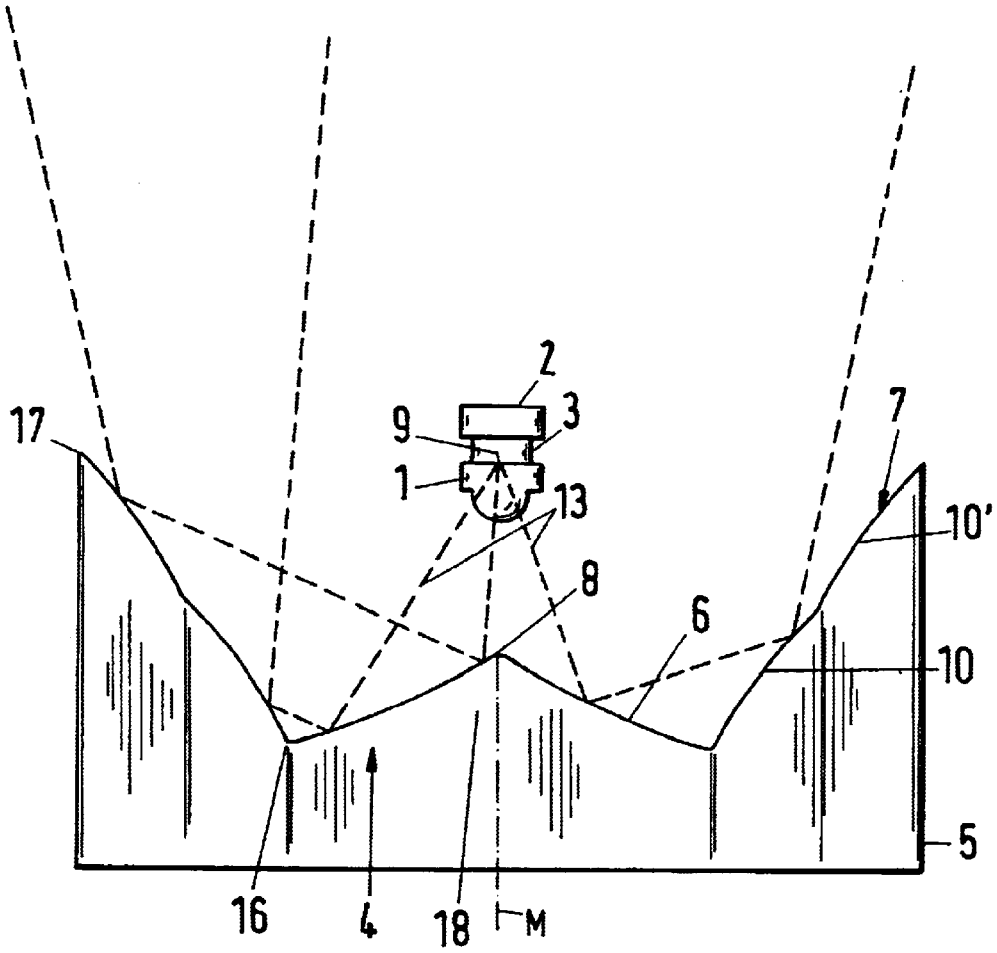
FIG. 1 is a schematic simplified illustration of a part of a first reflector according to the invention in axial section.
Figure 6:
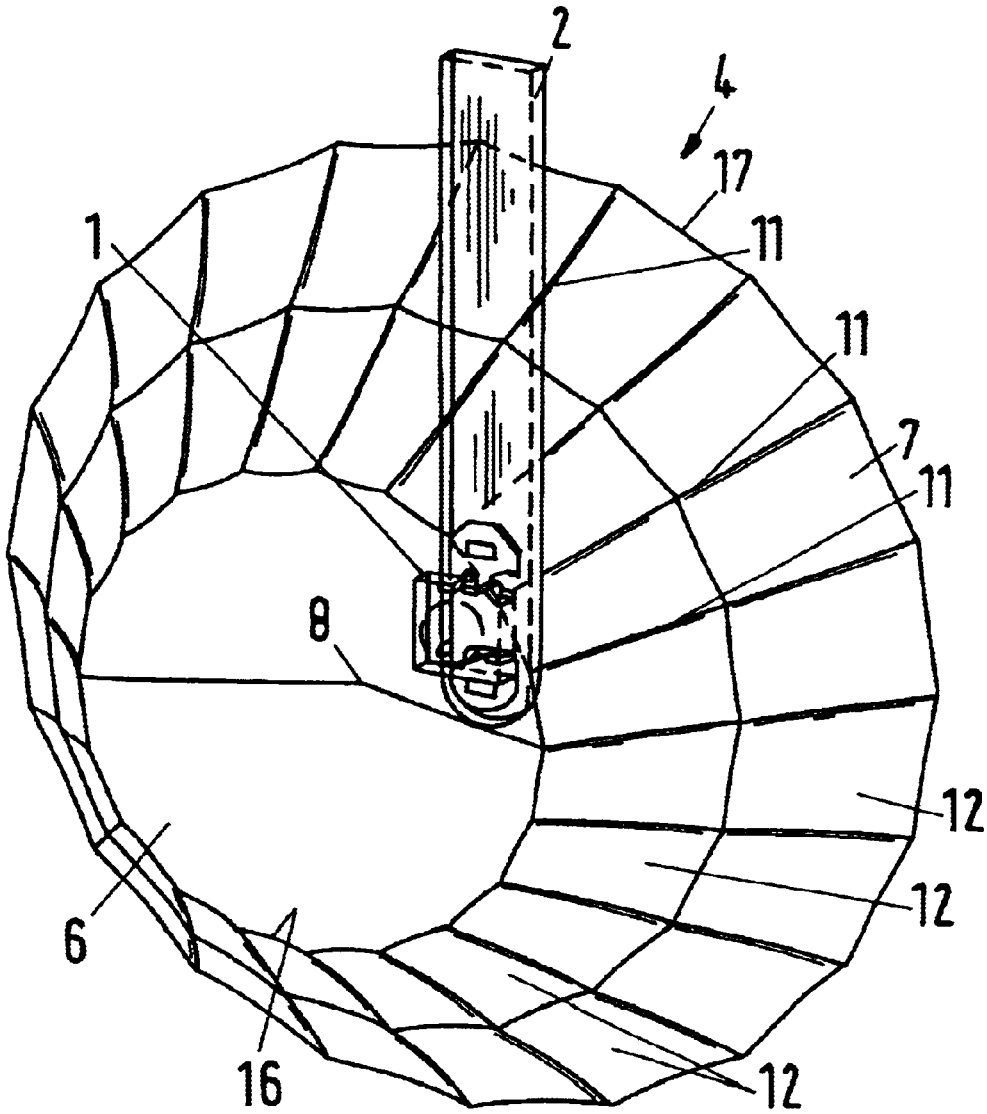
FIG. 6 shows the reflector of FIG. 1 in a perspective illustration.
Figure 7A:
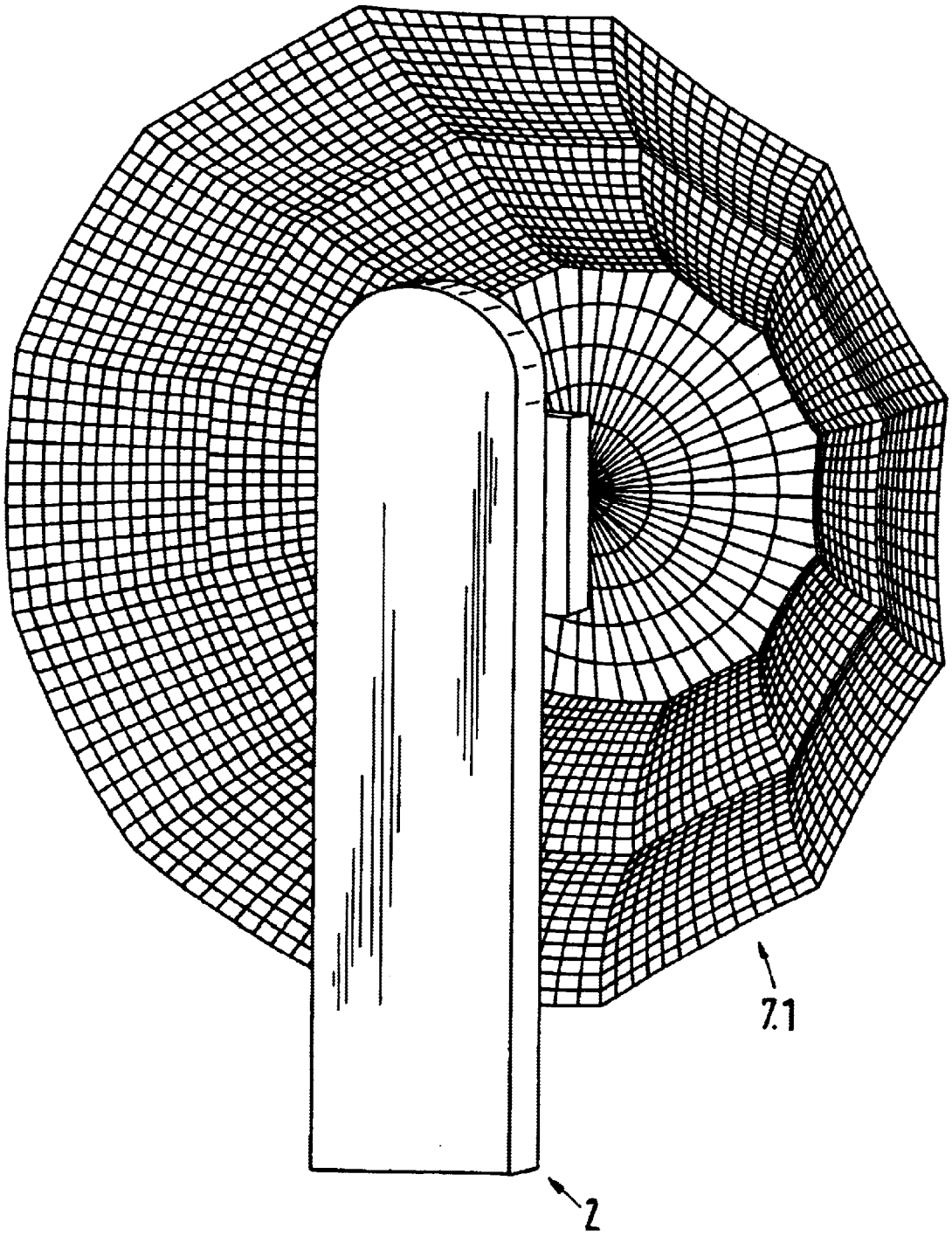
FIG. 7*a* shows a perspective view of en outer reflector part (7.1) with cushion-shaped reflector sections (7.1).
Figure 7B:
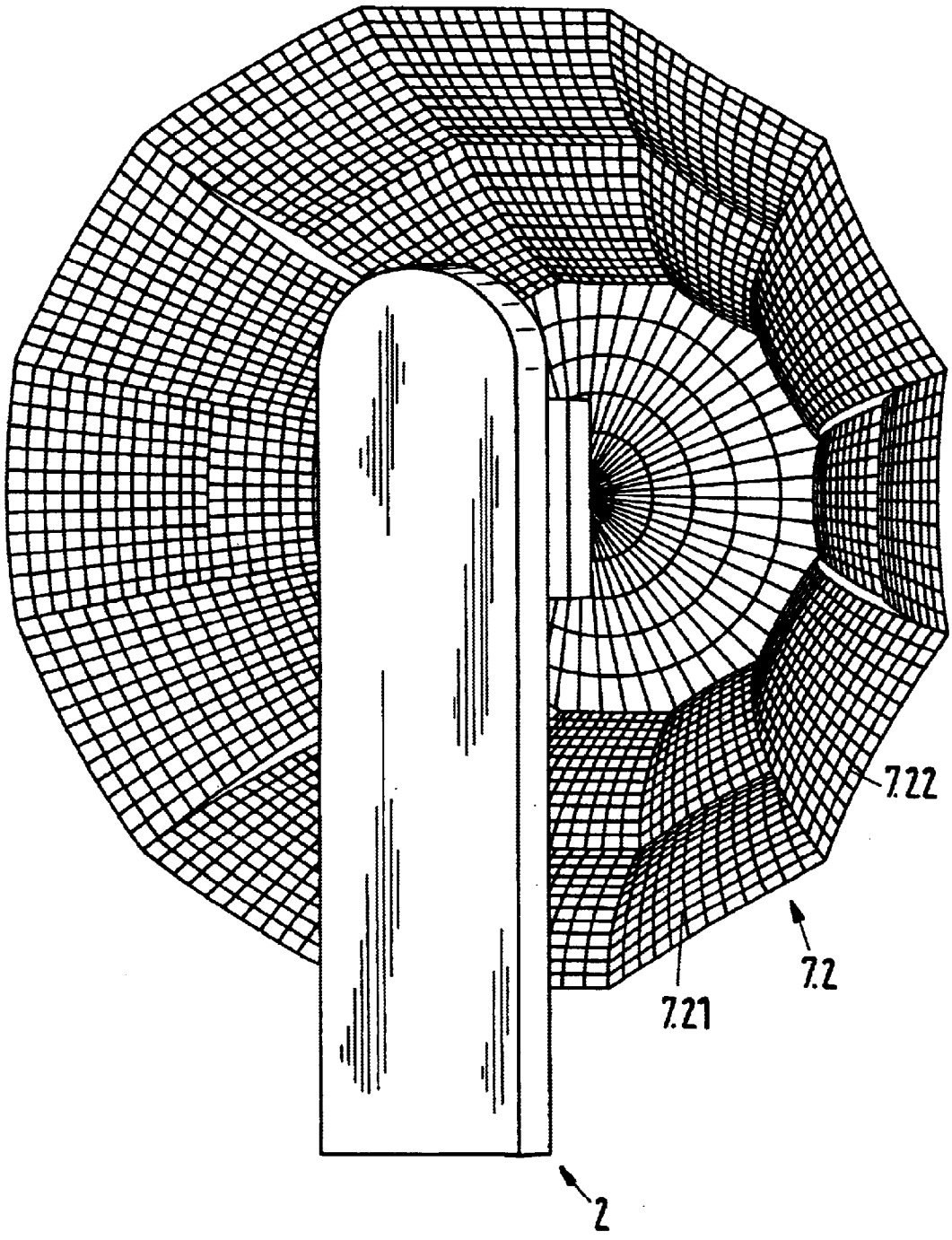
FIG. 7*b* shows a perspective view of an outer reflector part (7.2) with cushion-shaped (7.21) and roller-shaped (7.22) reflector sections.
Figure 7C:
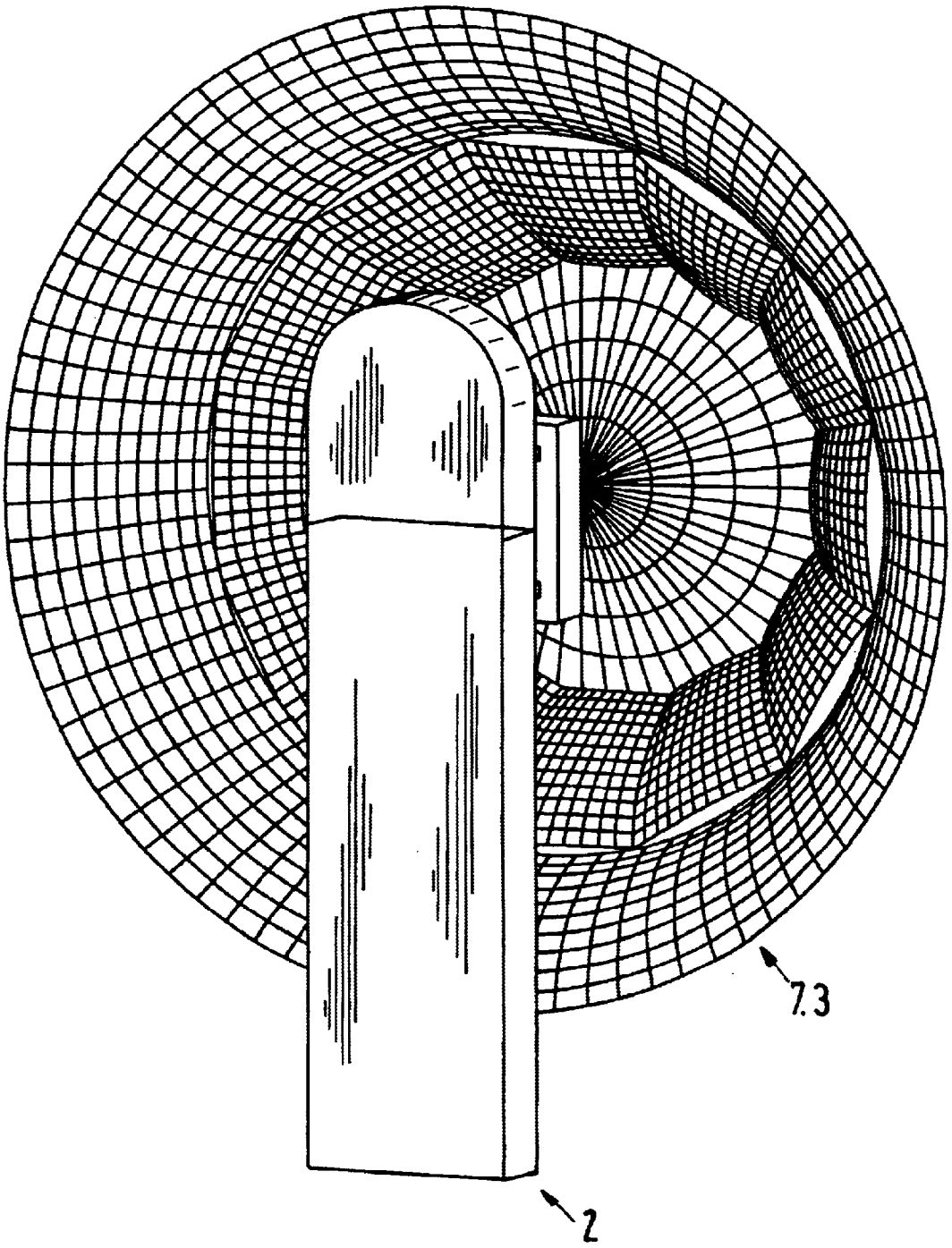
FIG. 7*c* shows a perspective view of an outer reflector part (7.3) with roller-shaped reflector sections.
Figure 8:
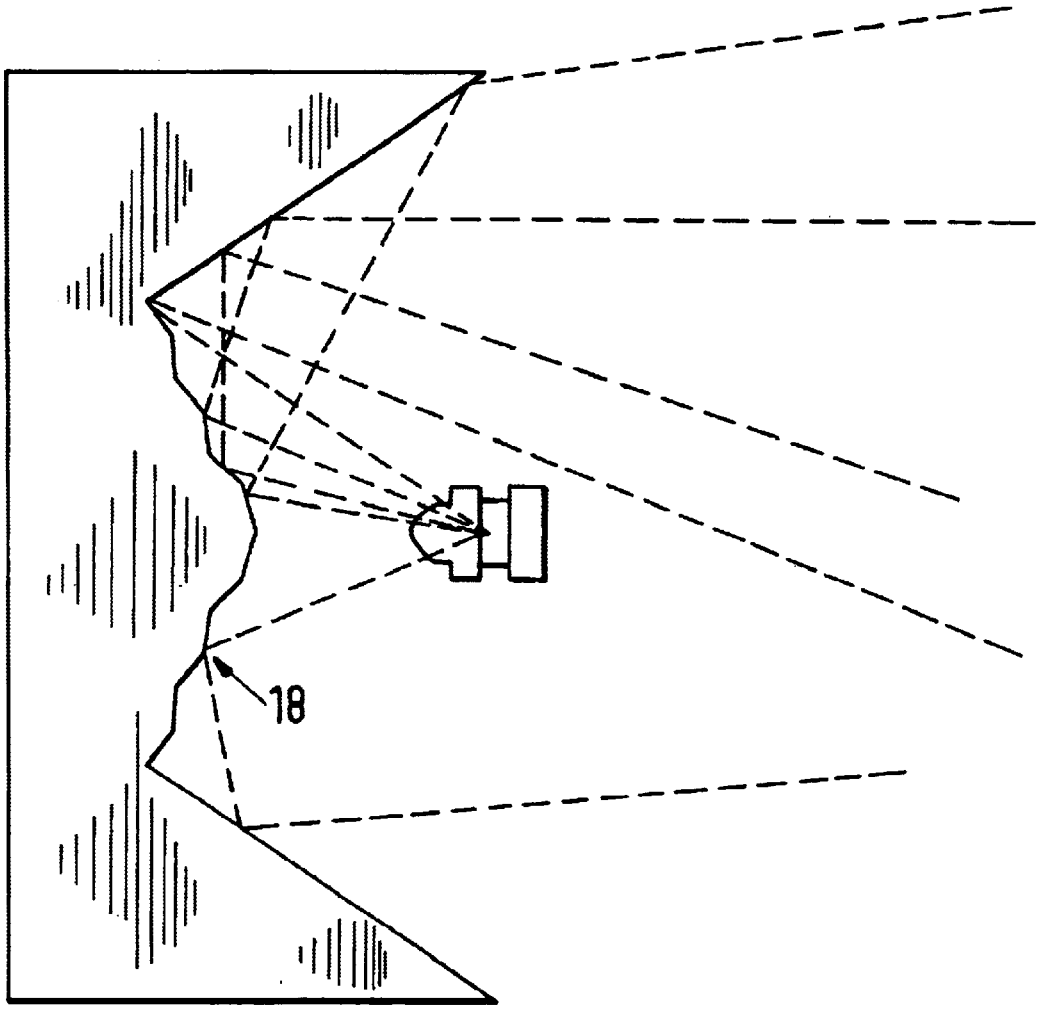
FIG. 8 is a schematic simplified illustration similar to FIG. 4 of a reflector showing roller-shaped optics on the central body (18).

FIGS. 1 and 6 show a reflector for a light assembly, in particular, for a headlight of motor vehicles. The reflector has an annular body 5 of which FIG. 1 shows only one part. The housing (not illustrated) which receives the reflector has a housing opening which is covered by a lens (also not illustrated). Within the annular body 5 an illumination element in the form of an LED 1 is arranged which is fastened on the support 2 by means of a securing leg 3. The LED 1 is arranged at a spacing in front of a reflector 4 which is part of the annular body 5.

The support 2 of the LED 1 is preferably embodied as an elongated stay (FIG. 6) comprised of a transparent plastic material and provided with conductors for supplying electrical current.

The reflector 4 has an inner reflector surface 6 which is formed as an exterior side of a body of revolution 18 whose generatrix is a part of a parabola rotated about a centerline M. The resulting body of revolution 18 has a tip 8 positioned on the centerline M. The focal point 9 of the reflector 4 or of the body of revolution 18 is also positioned on the centerline M. The reflector surface 6 in axial section is concavely curved.

An outer reflector part 7 adjoins the reflector surface 6 and extends about the circumference of the reflector 4 and widens in the outward direction. The reflector part 7 is divided into two adjoining annual parts 10, 10' which are each comprised of cushion-shaped reflector sections 12. The reflector sections 12 within one annular part 10, 10' are advantageously of the same size (FIG. 6) and adjoin one another. The reflector sections 12 of the annular part 10 are advantageously of the same size as the reflector sections 12 of the annular part 10'. In a plan view, the reflector sections 12 have a rectangular contour. The reflector sections 12 within the two annular parts 10, 10' are positioned sequentially in the direction of height of the reflector 4. In this way, grooves 11 (FIG. 6) are provided between the reflector sections which, in a plan view onto the reflector 4, extend straight from the rim 16 of the reflector surface 6 to the outer edge 17 of the reflector 4. The outer reflector part 7 projects past the tip of the inner reflector body 18 and the LED 1.

The reflector 4 is embodied such that the rays 13 emitted by the LED 1 are completely received by it and used for light distribution. The light rays 13 which extends divergingly away from the LED 1 impinge first on the reflector surface 6. The reflector surface 6 reflects the light rays 13 to the reflector part 7 where they are reflected outwardly to the lens (not illustrated). The light rays 13 are scattered on the cushion-shaped reflector sections 12. It is also possible to configure the outer reflector part 7 as a conical part. Because no scattering optics, such as the reflector sections 12, are provided, the light 13 is reflected in this case to the exterior as a parallel light bundle.

As a result of the describe configuration, it is achieved that the light assembly comprising only a single LED 1 has a very minimal mounting depth and provides a large illuminated surface. The described reflector 4 can be used for all kinds of illumination purposes such as motor vehicle taillights, motor vehicle headlights, motor vehicle interior lights as well as illumination devices of all kinds.

Instead of the cushion-shaped reflector sections 12, scatter optics in the form of roller-shaped reflector sections or any other suitably configured reflector sections can be used within the outer reflector part 7. In this case, the lens does not have to provide a scattering function for the light and can therefore be embodied as a simple inexpensive lens.

Figure 2:
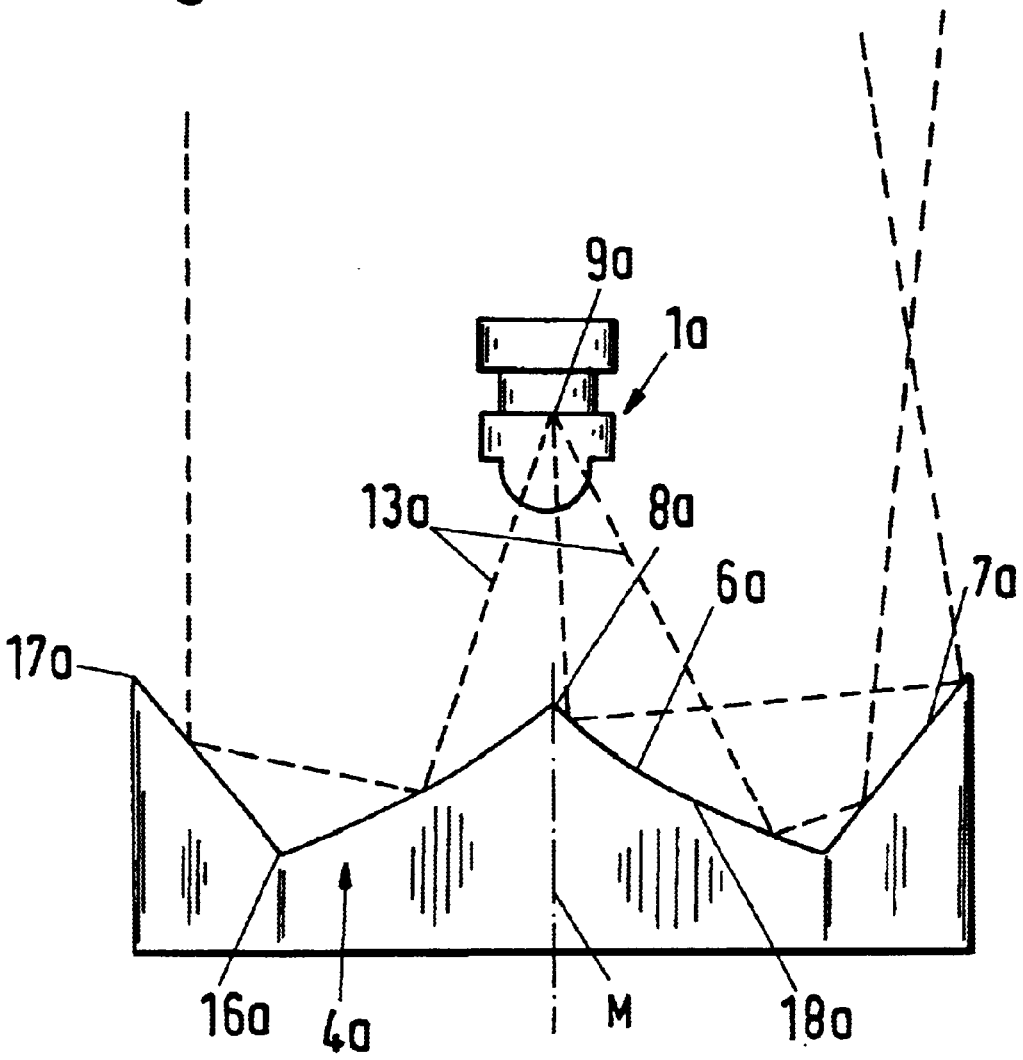
FIG. 2 is a schematic simplified illustration of a part of a second reflector according to the invention in axial section.

In the embodiment according to FIG. 2, the body of revolution 18*a* comprising the reflector surface 6*a* has a generatrix which is part of an ellipse rotated about the centerline M. The outer reflector part 7*a* has a reflector surface positioned on a conical mantle surface which extends from the outer rim 16*a* of the reflector surface 6*a* of the reflector 4*a* to the outer edge 17*a* of the reflector part 7*a*. In accordance with the preceding embodiment, the tip 8*a* is positioned at the center of the body of revolution 18*a* of the reflector 4*a*. The reflector surface 6*a* viewed in axial section is concavely curved.

As in the preceding embodiment the reflector surfaces 6*a* of the body of revolution 18*a* and the reflector surface of the reflector part 7*a* are arranged relative to one another such that the light rays 13*a* emitted by the LED 1*a* impinge on the reflector surface 6*a* and are reflected thereat toward the outer reflector part 7*a* which, in turn, reflects them onto the lens. The embodiment of the reflector surface 6*a* determines the resulting scattering. Alternatively, the reflector part 7*a* can be provided additionally with scattering optics.

The outer reflector part 7*a* has a smaller axial extension than the reflector part 7 and extends up to approximately the level of the tip 8*a*. Since the reflector part 7*a* has no scattering function, the lens (not illustrated) of the light assembly is provided with a scattering optic. The LED 1*a* is arranged, as in the preceding embodiment, such that its focal point is within the focal point 9*a* of the body of revolution 18*a*. The LED 1*a* is positioned within a focal point outside of the reflector 4*a*.

It is also possible that the reflector surface 6*a* as well as the reflector part 7*a* each fulfill a scattering function and are provided with scattering optics, e.g., those described above.

Figure 3:
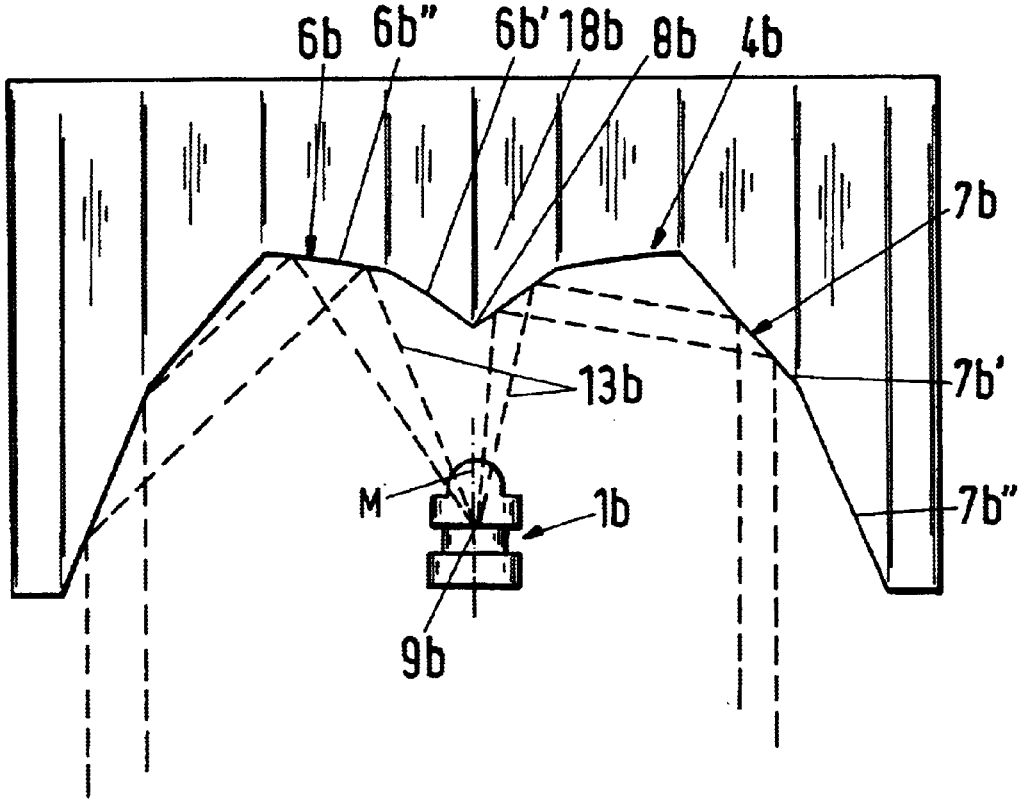
FIG. 3 is a schematic simplified illustration of a part of a third reflector according to the invention in axial section.

In the reflector 4*b* according to FIG. 3 the reflector surface 6*b* of the body of revolution 18*b* has two adjoining annular zones 6*b*′ and 6*b*″, wherein their generatrix is a part of a parabola, respectively. The parabola parts are differently inclined. The radially inwardly positioned parabola part (annular zone 6*b*′) extends more steeply than the outer parabola part (annular zone 6*b*″). The body of revolution 18*b* has a central tip 8*b* positioned, like the focal point 9*b* of the reflector 4*b*, on the centerline M. The outer reflector part 7*b* is comprised also of two annular zones 7*b*′ and 7*b*″ adjoining one another and each having a conical mantle surface as a reflector surface. The outer conical mantle surface (annular zone 7*b*″) extends more steeply than the inner conical mantle surface (annular zone 7*b*′). The annular zones 7*b*′, 7*b*″ can be provided with cushion-shaped, roller-shaped or any other type of suitable scattering optics. The LED 1*b* is positioned, as in the embodiment of FIG. 1, within the reflector 4*b*.

The light rays 13*b* emitted by the LED 1*b* reach the reflector surfaces of the annular zones 6*b*′, 6*b*″ where they are reflected onto the reflector surfaces of the annular zones 7*b*′, 7*b*″. Here the light rays 13*b* are reflected parallel to one another and to the centerline M out of the reflector 4*b* to the lens of the respective light assembly. The annular zone 6*b*′ is correlated with the annular zone 7*b*′ and the annular zone 6*b*″ is correlated with the annular zone 7*b*″.

Figure 4:
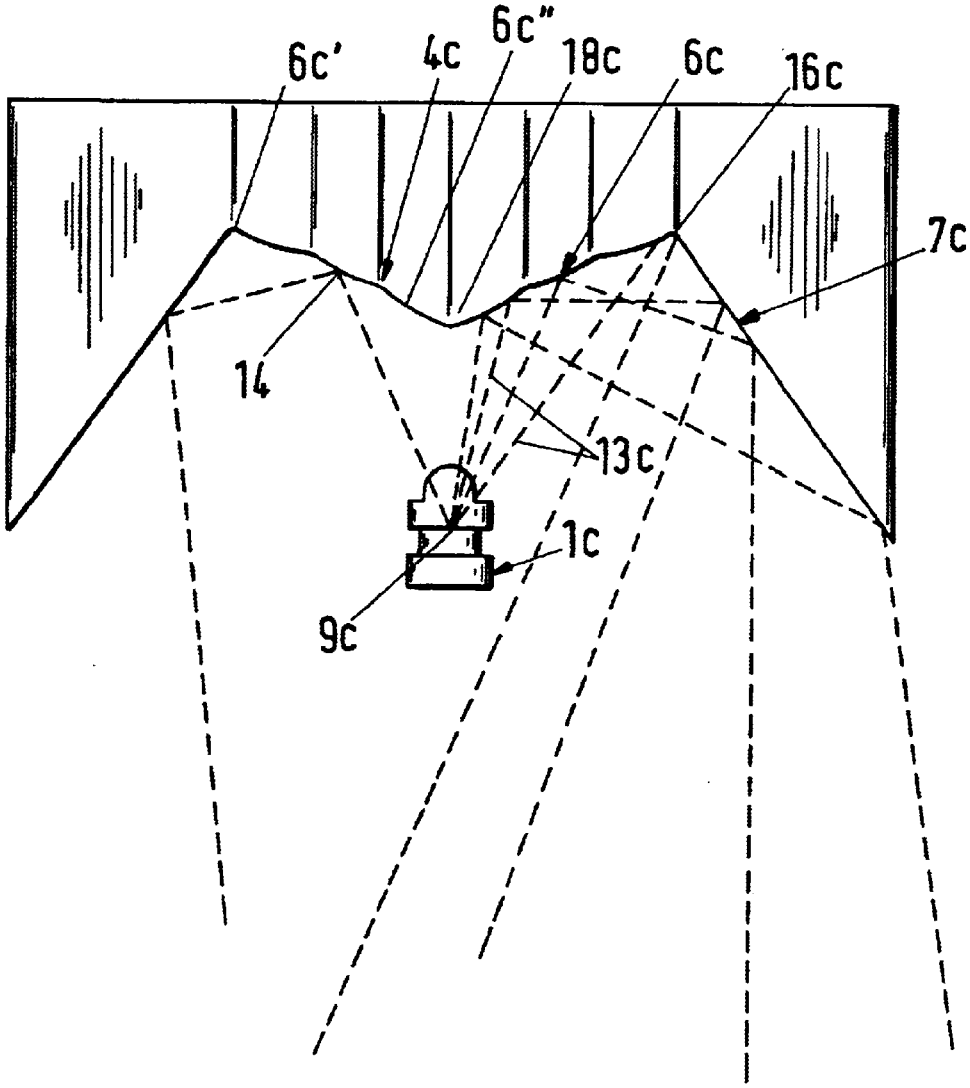
FIG. 4 is a schematic simplified illustration of a part of a fourth reflector according to the invention in axial section showing cushion-shaped optics on the central body.

In the reflector 4*c* according to FIG. 4, the central body of revolution 18*c* is provided with the scattering optics 6*c*′, 6*c*″, 14 which are preferably cushion-shaped optics and are positioned on parabolas, respectively. A conical mantle surface of the outer reflector part 7*c* adjoins the circumferential outer rim 16*c* of the body of revolution 18*c*. The conical mantle surface can be provided with a scattering optic. The reflector part 7, as in the embodiment of FIG. 1, has a substantially greater axial extension than the body of revolution 18*c*. The focal point 9*c* of the reflector 4*c* in this embodiment also coincides with the focal point of the LED 1*c*. The diverging rays 13*c* emitted by the LED 1*c* are reflected on the reflector surfaces 6*c* of the body of revolution 18 to the conical mantle surface of the reflector part 7*c* where they are reflected to the exterior. The LED 1*c* is positioned centrally within the annular reflector 4*c*.

Figure 5:
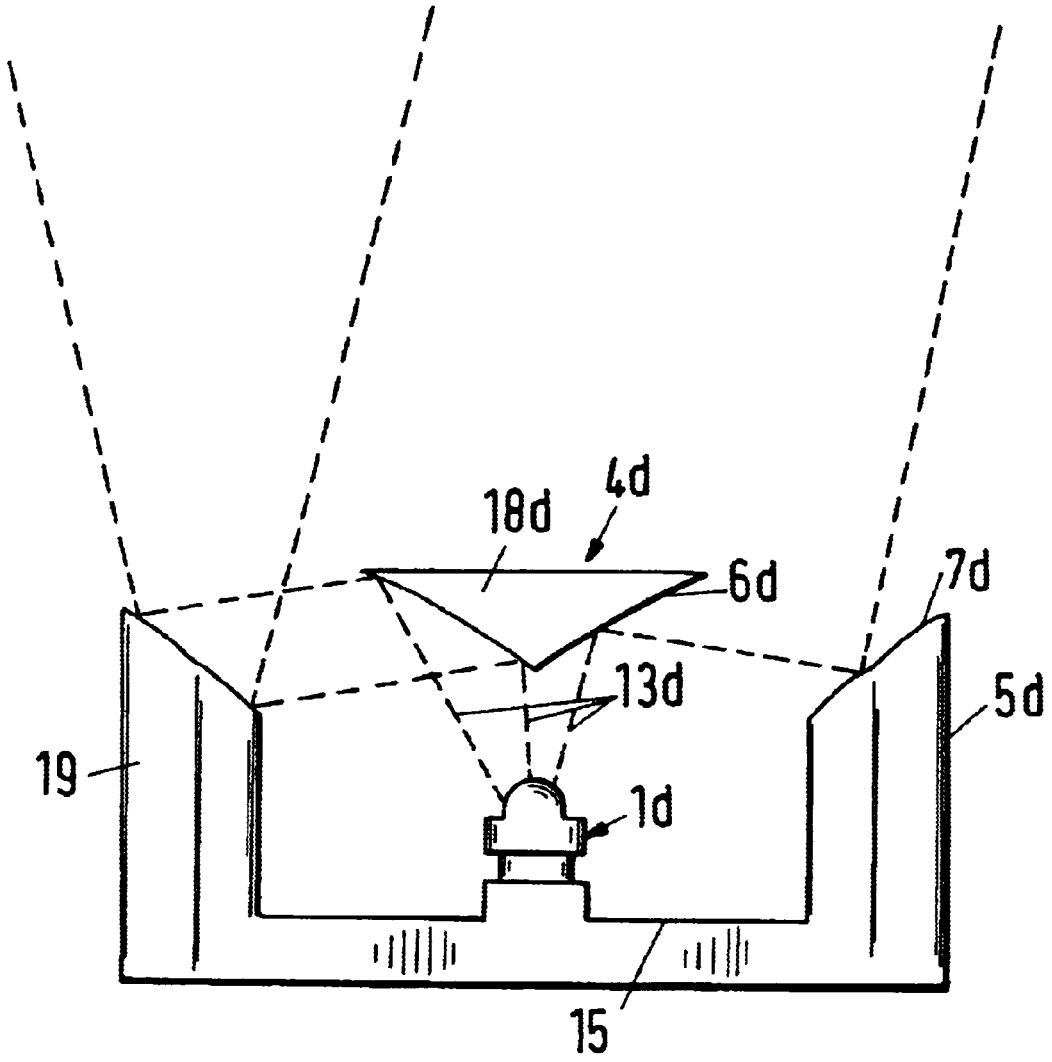
FIG. 5 is a schematic simplified illustration of a part of a fifth reflector according to the invention in axial section.

In the embodiment according to FIG. 5, the LED 1*d* is arranged in the area between a back wall 15 and the body of revolution 18*d* which is of identical configuration as the body of revolution 15 of FIG. 1. The LED 1*d* is fastened on the back wall 15. The light rays 13*d* emitted by the LED 1*d* impinge on the reflector surface 6*d* of the body of revolution 18*d* forming a reflector 4*d* where the light rays are reflected onto the outer reflector part 7*d*. It is a part of an annual wall 19 of the annular body 5*d* and has a reflector surface located on the conical mantle surface. On it the light rays are reflected onto the tens (not illustrated). In the reflector surface of the outer reflector part 7*d*, as in the embodiment, scattering optics can be provided. The LED 1*d* is positioned centrally in the housing 5*d*. The body of revolution 18*d* projects partially into the space surrounded by the annular wall 19. The body of revolution 18*d* is configured and arranged such that all light rays 13*d* impinging on its reflector surface 6*d* are reflected to the outer reflector part 7*d*. The LED 1*d* is covered by the body of revolution 18*d* relative to the lens. In this way, the light emitted by the LED does not directly reach the lens so that high luminance and glare correlated therewith are prevented. The body of revolution 18*d* can also be provided on the lens, preferably, as a unitary part thereof.

In the described embodiments, all of the light emitted by the LED is completely received and utilized in a targeted way for light distribution. The body of revolution, respectively, can be viewed as an outwardly turned paraboloid or ellipsoid which shapes the diverging LED light to a preferably parallel or diverging bundle of rays directed outwardly. By means of additional reflector surfaces on the reflector parts 7 to 7*c* the light is deflected into the final emission direction. As a result of the described embodiment of the reflectors a high luminance of the LED light source which has high luminance and is approximately point-shaped is prevented.

In deviation from the illustrated embodiments, the illumination element can be positioned also directly on the lens.

While specific embodiments of the invention have been shown and described in detail to illustrate the inventive principles, it will be understood that the invention may be embodied otherwise without departing from such principles.

What is claimed is:

1. A reflector for a light assembly of a motor vehicle, the reflector comprising at least one reflector surface for rays emitted by an illumination element positioned at a spacing to the at least one reflector surface, wherein the at least one reflector surface is a surface of revolution whose generatrix is part of a curve and ascends in a direction to the illumination element oriented toward the at least one reflector surface, wherein the at least one reflector surface is provided with a scattering optic.

2. The reflector according to claim 1, wherein the curve is a part of a parabola.

3. The reflector according to claim 1, wherein the curve is a part of an ellipse.

4. The reflector according to claim 1, wherein the curve has a free-form course.

5. The reflector according to claim 1, wherein the at least one reflector surface is provided centrally with a tip oriented toward the illumination element.

6. The reflector according to claim 1, wherein a focal point of the illumination element coincides substantially with a focal point of the at least one reflector surface.

7. The reflector according to claim 1, wherein the at least one reflector surface has at least two annular zones adjoining one another.

8. The reflector according to claim 7, wherein the generatrix of each one of the at least two annular zones is a part of a parabola, of an ellipsoid, or a tree-form curve shape.

9. The reflector according to claim 7, wherein the at least two annular zones comprise an outer annular zone and an inner annular zone and wherein the outer and inner annular zones have different slants.

10. The reflector according to claim 1, wherein the scattering optic comprises roller-shaped sections or cushion-shaped sections.

11. The reflector according to claim 1, comprising a support on which the illumination element is fastened.

12. The reflector according to claim 11, wherein the support is strip-shaped.

13. The reflector according to claim 11, wherein the support is comprised of transparent material.

14. The reflector according to claim 13, wherein the transparent material is a plastic material.

15. The reflector according to claim 1, wherein the illumination element is fastened on a lens of a light assembly.

16. The reflector according to claim 1, wherein the illumination element is an LED.

17. The reflector according to claim 1, further comprising an outer reflector part, wherein the at least one reflector surface is surrounded by the outer reflector part.

18. The reflector according to claim 17, wherein the outer reflector part adjoins the at least one reflector surface.

19. The reflector according to claim 17, wherein the outer reflector part projects past the at least one reflector surface in an axial direction of the reflector.

20. The reflector according to claim 17, comprising an inner part comprising the at least one reflector surface, wherein the outer reflector part is a unitary part with the inner part.

21. The reflector according to claim 17, wherein the outer reflector part and the at least one reflector surface are arranged coaxially to one another.

22. The reflector according to claim 17, wherein the outer reflector part has a reflector surface located substantially on a conical mantle surface.

23. The reflector according to claim 22, wherein the reflector surface of the outer reflector part comprises at least two axially sequentially arranged annular zones having different slants.

24. The reflector according to claim 22, wherein the at least two annular zones of the outer reflector part in axial section are convexly curved, concavely curved, or concavely and convexly curved reflector surfaces.

25. The reflector according to claim 23, wherein the at least two annular zones have identical widths.

26. The reflector according to claim 17, wherein the outer reflector part has a scattering optic.

27. The reflector according to claim 26, wherein the scattering optic comprises cushion-shaped sections, roller-shaped sections, or cushion-shaped and roller-shaped sections.

28. The reflector according to claim 17, wherein the outer reflector part is connected to a lens of a light assembly.

29. The reflector according to claim 28, wherein the outer reflector part and the lens form a unitary part.

30. A reflector for a light assembly of a motor vehicle, the reflector comprising:

at least one reflector surface for rays emitted by an illumination element positioned at a spacing to the at least one reflector surface, wherein the at least one reflector surface is a surface of revolution whose generatrix is part of a curve and ascends in a direction to the illumination element oriented toward the at least one reflector surface;

an outer reflector part, wherein the at least one reflector surface is surrounded by the outer reflector part and wherein the outer reflector part has a scattering optic.

* * * * *